US009302297B2

(12) United States Patent
Pullen et al.

(10) Patent No.: US 9,302,297 B2
(45) Date of Patent: Apr. 5, 2016

(54) RAIN GUTTER CLEANING DEVICE

(71) Applicant: ENVIRONMENTAL SOLUTIONS INTERNATIONAL, Batavia, IL (US)

(72) Inventors: Kent L. Pullen, Downers Grove, IL (US); Kenneth Arnswald, Downers Grove, IL (US)

(73) Assignee: Environmental Solutions International, Batavia, IL (US)

( * ) Notice: Subject to any disclaimer, the term of this patent is extended or adjusted under 35 U.S.C. 154(b) by 498 days.

(21) Appl. No.: 13/782,975

(22) Filed: Mar. 1, 2013

(65) Prior Publication Data

US 2014/0246046 A1 Sep. 4, 2014

(51) Int. Cl.

| | |
|---|---|
| ***A47L 13/24*** | (2006.01) |
| ***E04D 13/076*** | (2006.01) |
| ***B08B 1/00*** | (2006.01) |
| ***A47L 13/255*** | (2006.01) |
| ***A47L 13/46*** | (2006.01) |

(52) U.S. Cl.

CPC ..... *B08B 1/006* (2013.01); *A47L 13/24* (2013.01); *A47L 13/255* (2013.01); *A47L 13/46* (2013.01); *B08B 1/00* (2013.01); *B08B 1/002* (2013.01); *E04D 13/0765* (2013.01)

(58) Field of Classification Search

CPC ..... A47L 13/255; A47L 1/15; A47L 13/10; B08B 1/002; B08B 3/04; E04D 13/0765

See application file for complete search history.

(56) References Cited

U.S. PATENT DOCUMENTS

| | | | | |
|---|---|---|---|---|
| 2,817,867 | A | 12/1957 | Copelin | 15/172 |
| 2,987,745 | A * | 6/1961 | Ballinger | 15/229.8 |
| 3,076,216 | A | 2/1963 | Anderson | 15/116.2 |
| 3,945,736 | A * | 3/1976 | Rittenbaum et al. | 401/289 |
| 4,524,484 | A | 6/1985 | Graham | 16/429 |
| 4,794,663 | A | 1/1989 | Vosbikian | 15/229.6 |
| 5,406,670 | A | 4/1995 | Juratovac et al. | 15/229.2 |
| 5,452,491 | A * | 9/1995 | Thompson | 15/229.8 |
| D407,901 | S | 4/1999 | Burton | D4/135 |
| 6,842,937 | B2 | 1/2005 | Li | 15/236.04 |
| 8,266,756 | B1 | 9/2012 | Kovarik | 15/210.1 |
| 8,272,801 | B2 | 9/2012 | Linzell | 401/261 |
| 2004/0064909 | A1 | 4/2004 | Locklear | 15/160 |
| 2006/0117510 | A1 | 6/2006 | Sellers | 15/160 |
| 2006/0191089 | A1 * | 8/2006 | Gracindo et al. | 15/144.4 |
| 2007/0186365 | A1 | 8/2007 | Armaly, Jr. | 15/244.1 |
| 2008/0282489 | A1 * | 11/2008 | Monahan et al. | 15/228 |
| 2010/0065082 | A1 | 3/2010 | Dinh | 134/6 |

FOREIGN PATENT DOCUMENTS

| | | |
|---|---|---|
| CN | 202376042 U | 8/2012 |
| GB | 1128520 A | 9/1968 |
| GB | 2 411 578 A | 9/2005 |

* cited by examiner

*Primary Examiner* — Michael Kornakov
*Assistant Examiner* — Natasha Campbell
(74) *Attorney, Agent, or Firm* — Winston & Strawn LLP

(57) ABSTRACT

The present invention relates to a product and method for cleaning outdoor surfaces. The product may include a support member and a cleaning element. The support member may include top and bottom portions, the top portion may include a connector configured and dimensioned for receiving and attaching a pole to the support member. The bottom portion may include a structural support for providing rigidity to the support member. The cleaning element associated with the structural support. The cleaning element may include a cleaning face operatively associated with the bottom portion of the support member. The structural support may transfer cleaning forces to the cleaning element. Examples of the type of cleaning element may be a mitt or an alignment plate. The cleaning element may be made of a material that is washable, durable and absorbent and the structural support may be removable from the cleaning element when not in use.

17 Claims, 6 Drawing Sheets

RAIN GUTTER CLEANING DEVICE

FIELD OF THE INVENTION

The present invention relates to outdoor cleaning products and in particular to a pole mounted cleaning device having various attachments for cleaning outdoor surfaces such as building siding, windows and rain gutters.

BACKGROUND OF THE INVENTION

Cleaning the outside surfaces and components of a person's home or building can not only be time consuming but strenuous and dangerous, as well. For example, cleaning the higher, hard to reach portions of a home or building may require equipment, such as a ladder. Utilizing a ladder while performing cleaning motions, such as scrubbing, can cause the ladder or the person to become unstable. Cleaning a typical home or building's first and second floors would take multiple hours if done with ladders and extension ladders. Also, going up and down the ladder repeatedly to act supplies can be very strenuous and exhausting. Both of these situations could ultimately result in injury. An alternative could be hiring a professional but that can be very costly.

It would be beneficial to develop a tool that is easy to use and works quickly to an individual looking to minimize the amount of time cleaning. It is an object of the present invention to provide a product that is a simplified an and easy to use solution to cleaning outside surfaces.

SUMMARY OF THE INVENTION

According to the principles of the invention, a product for outdoor cleaning is provided, the product comprising a support member and a cleaning element. The support member includes top and bottom portions, wherein the top portion includes a connector configured and dimensioned for receiving and attaching a pole thereto and the bottom portion includes a structural support for providing rigidity to the support member. In one embodiment, the connector includes a pivot means that allows the product to retain flush contact with an outdoor surface regardless of application angle. Different cleaning elements are provided depending upon the type of surface to be cleaned.

The cleaning element is associated with the structural support, wherein the cleaning element includes a cleaning face operatively associated with the bottom portion of the support member. The cleaning element is made of a material that is washable, durable and absorbent and the structural support is removable from the cleaning element when not in use.

In one embodiment, the cleaning element is configured as a mitt having a front and back surfaces and an opening for receiving and enclosing the support member therein. The front surface representing the cleaning face and including a plurality of spaced flexible elongated members are extended from the cleaning face. The back surface includes an opening to allow the pole connector of the support member to pass through. In another embodiment, the cleaning element includes an external layer that provides the elongated members and an internal layer that includes a porous material. The internal layer provides compressibility to the front surface to assist in conforming to the area to be cleaned. In yet another embodiment, the external layer and elongated members are made of nylon or microfiber material and the support member is made of a plastic material having sufficient strength and rigidity to provide those properties to the support member. In another embodiment, the flexible elongated members are made of nylon bristles.

In one embodiment, the mitt includes an enclosing means to further secure the support member between the front and back surfaces but that allows the mitt to be removable from the support member when not in use. The opening of the mitt may include a closure element, which includes mating portions for joining the front and back surfaces while securing the support member in between the front and back surfaces. In other embodiments, the closure element includes hook and loop fasteners, a zipper, male and female snaps, or a button and hole arrangement.

In one embodiment, a foam member is positioned and located between the cleaning face of the cleaning element and the bottom portion of the support member. Preferably, the foam member is made of a porous material that provides compressibility to the cleaning face to assist in conforming the cleaning face to an area to be cleaned and to assist in transferring cleaning forces to the cleaning face. The foam member may be part of the internal layer.

In another embodiment, the cleaning element includes an alignment plate that is removably engageable with the structural support of the support member and a plurality of flexible elongated members extending from the plate for providing cleaning engagement with a surface to be cleaned. Preferably, one of the alignment plate and structural support includes apertures and the other of the alignment plate and structural support includes protuberances that engage the apertures to provide a secure attachment between the alignment plate and structural support. In another embodiment, one of the alignment plate and structural support includes a rail and the other of the alignment plate and structural support includes a channel that allows sliding movement of the rail therein to provide a secure attachment between the alignment plate and structural support. In another embodiment, the shape of the support member can have a rounded shape or be a polygon with circles, ovals, rectangles, squares or triangles being representative. Combinations of such shapes can also be provided depending upon the configurations of the surfaces to be cleaned.

According to the principles of the invention, a method for cleaning outdoor surfaces is provided, which includes attaching a pole to the connector of the cleaning element, performing cleaning motions along the outdoor surface with the flexible elongated members of the cleaning element, optionally with the addition of a cleaning agent. In one embodiment, upon completion of the cleaning of the outdoor surface, removing the support member from the cleaning element so that the cleaning element may be washed or cleaned prior to subsequent usage. Typical outdoor surfaces to be cleaned include siding, windows or roof mounted rain gutters or downspouts.

BRIEF DESCRIPTION OF THE FIGURES

The present invention may be understood more fully by reference to the following detailed description of the preferred embodiment of the present invention, illustrative examples of specific embodiments of the invention and the appended figures in which.

DETAIL DESCRIPTION OF THE PREFERRED EMBODIMENTS

The present method and product will be described in connection with the figures, it being understood that the description and figures are for illustrative, non-limiting purposes.

Figure 1:
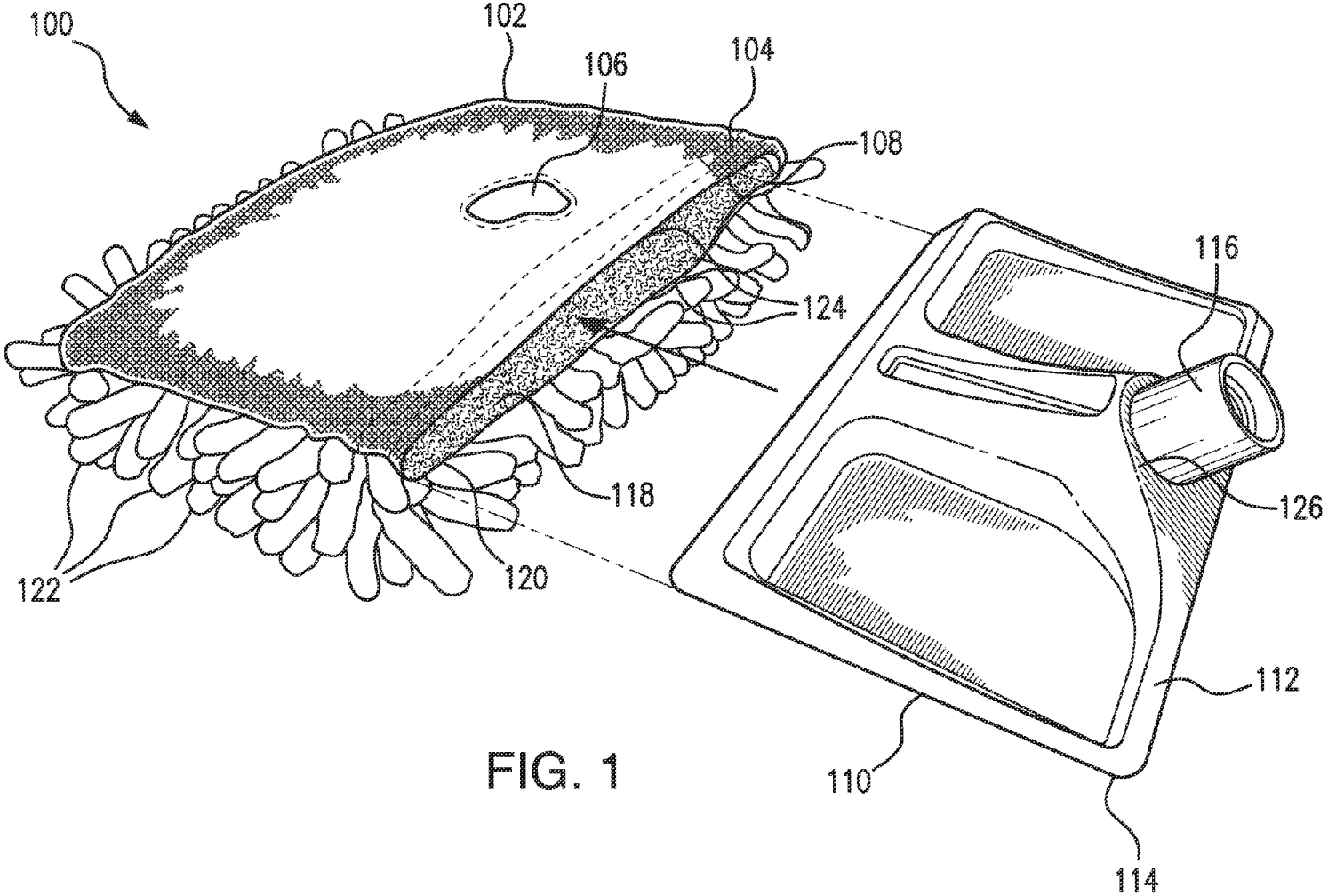
FIG. 1 is an exploded view of one embodiment of the product in accordance with some embodiments of the present invention.

With reference to FIG. 1, illustrated is an exemplary product for cleaning outdoor surfaces. FIG. 1 illustrates an exploded view of one embodiment of the product 100. In this embodiment, product 100 includes a cleaning element 102 that encloses a support member 110. In this embodiment, the cleaning element is configured as a mitt having a back surface 104 and a front surface 120. It should be appreciated that the present invention is not limited to the cleaning element only being a mitt, as a number of other embodiments are described herein. The cleaning element 102 also includes an opening 106 for receiving and accommodating a support member connector 116, and an underside of the back surface 108. When the cleaning element 102 and the support member 110 are combined, the underside of the back surface 108 is flush against a top portion 112 of the support member 110. The support member 110 also includes a bottom portion 114, and the connector 116. The front surface 120 of the cleaning element 102 also includes an inside surface 118 so that when the cleaning element 102 and the support member 110 are combined, the inside surface 118 is flush against the bottom portion 114 of the support member 110.

The support member 110 may also be in a variety of different shapes. For example, the support member may be rectangular, circular, triangular, oval-shaped, etc. In a preferred embodiment for cleaning a rain gutter or downspout, the support member has rectangular shape. The shape of the support member may provide different functionalities for different outdoor cleaning tasks. For example, cleaning a roof-mounted rain gutter requires a different shape than cleaning siding of a home. These are just two examples of the types of outdoor cleaning tasks that the device may be used to perform. The bottom portion 114 of the support member 110 may also include a grid support structure. The grid support structure may also be part of the structural support (not shown). The grid support structure may be arranged in a variety of different arrangements to provide rigidity to the support structure.

The support member 110 also includes a top portion 112 that includes a connector 116 for receiving and attaching a pole to the support member 110. The type of pole may be any standard handle or extension pole. The connector 116 may also include universal threads to screw the pole into the connector for added stability. The connector 116 may include internal thread, which mate with external threads that are provided at the end of the pole (not shown). The connection for attaching the pole can be added to the support member 110 in a fixed position or in an adjustable position. The pole length is selected based on the location that has to be cleaned and typically will be between five and twenty-five feet. The connector 116 may also include a pivot means 126 to provide for flexible motion of the product that allows the product to remain flush contact with the surface regardless of the application angle. The pivot means 126 may allow for rotation or multi-angle maneuverability of the product.

The support member 110 can made of many different types of products. For example, the support member may be made of plastic, metal, or any other type of material that provides rigidity and support to the cleaning element 102 while being lightweight. The support member 110 has a number of utilities. It provides support, rigidity and strength to the cleaning implements that are attached hereto. For example, a cleaning element (e.g. a mitt, an alignment plate, etc.) can be removeably attached as disclosed herein for cleaning surfaces that are relatively smooth, such as a rain gutter or siding (aluminum or otherwise), and even for surfaces that are rough, such as concrete, brick, etc.

Alternatively, an alignment plate provided with bristles or other more rigid cleaning elements can be mounted upon the support to convert the device into a brush-like structure having stiff or more flexible bristles for cleaning harder surfaces, such as brick, cement, or concrete. This embodiment is discussed and illustrated below with regard to FIG. 5.

The front surface 120 of the cleaning element 102 also includes a plurality of spaced flexible elongated members 122. The front surface 120 may also be considered the cleaning face of the cleaning element 102. The plurality of spaced flexible elongated members 122 extend from the front surface 120. The opening 124 of the cleaning element 102 is used to receive and enclose the support member 110. The opening 124 should be at least as large so that the support member 110 can fit inside of the cleaning element 110. The cleaning element 102 may also include an enclosure means within the opening 124 to secure the structural support in place. The enclosure means may include a closure element associated with the opening 124 for securing the support member 110 to the cleaning element 102. The closure element may include mating portions for joining the front surface 104 and the back surface 120 while securing the support member 110 in between. For example, the closure element may be a hook and loop fastener, male and female snaps, zipper, button and hold arrangement, etc.

The cleaning element 102 may also include an exterior layer 104, 120 and an internal layer (not shown). The external layer 104, 120 may provide the elongated members 122 and be made of a microfiber or similar material. The internal layer may be made of a porous material that provides compressibility to the front surface to assist in conforming to an area to be cleaned. The porous material may include different types of material that provide these functionalities, such as foam, sponges, etc. The porous material should not be too absorbent so as to retain too much water or liquid that would cause using the product at great heights to be more difficult and tiring. The internal layer may be attached to the external layer 104, 120 or the internal layer may be removable.

The cleaning element 102 is made of a material that is washable, durable and absorbent. The cleaning element 102 may be made of microfiber or similar materials. The material of the cleaning element 102 and the elongated members 122 need to be made of a cleaning material sufficiently strong enough to handle occasional rough exterior surfaces yet soft enough not to scratch paint or surfaces. The elongated members 122 may also be made of a material that provides some fiction or grip to allow for more thorough cleaning. The elongated members 122 may be soft and flexible or more firm. The elongated members 122 can be made of a polymeric material, especially one that is of nylon or other plastic or polymeric material that is somewhat resistant to abrasion. The elongated members 122 can be made of nylon but can also be of a microfiber-type material. As long as the material provides a texture that facilitates the removal of dirt or debris from the surface to be cleaned.

The compressibility of the cleaning element 102 allows the elongated members 122 to conform to an irregular surface of a rain gutter or other surface to be cleaned. For example, when cleaning the side of a house, the cleaning element 102 and elongated members 122 can conform to the edges between siding panels or can also conform to irregular areas, such as where windows or other openings are provided in the house walls. The compressible material can be sponge or foam, such as made of polyurethane, foam PVC, or other convention foam materials. The foam can be attached to the internal layer of the mitt or cleaning element, or can be provided as a separate item that is placed between the support member 110 and a working surface or front surface 120 of the mitt or cleaning element. The support member 110 is configured so that when pressed against the surface to be cleaned by the pole, it will exert sufficient cleaning pressure to remove dirt, debris or other contamination from that surface.

The cleaning element 102 and support member 110 product needs to be able to conform to the different surface contours of cleaning outdoors, such as siding, gutters, downspouts, etc. The combination 100 of the cleaning element 102 and the support member 110 also needs to be big enough to allow quick cleaning of substantial surface area at a time but not so large that the combination 100 is overly heavy and difficult to work with for projects requiring height. There are also many nooks and crannies, various angles on the exterior of a house or building that would require at least one angular point to allow the product to easily get into tight spots and clean.

Figure 2:
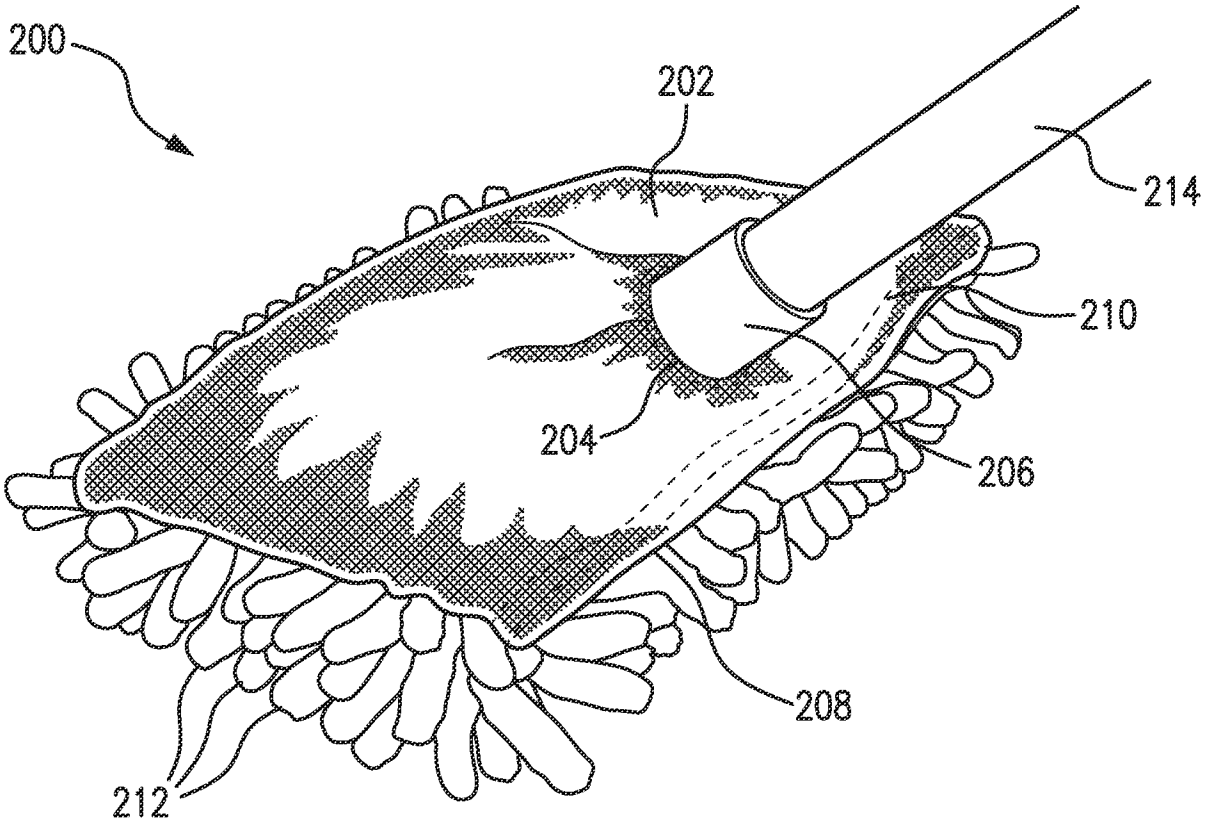
FIG. 2 is a view from the top of one embodiment of the product in accordance with some embodiments of the present invention.

Now referring to FIG. 2, which is a view 200 from the top of one embodiment of the product in accordance with some embodiments of the present invention. View 200 includes a back surface 202 of the cleaning element, an opening 204, a connector 206, an opening 208, an enclosure means 210, and elongated members 212. As discussed above, the opening 204 provides for the connector 206 of the support member (not shown) to pass through. The opening 208 allows the support member to fit inside the cleaning element. The opening 208 may further include an enclosure means 210 or a closure element, as discussed above. The enclosure means 210 or closure element may provide for a more secure fit for the support member within the cleaning element. This view 200 of the product is an example of what a user might see while performing the cleaning motions or tasks. View 200 is also an illustration of an embodiment with the cleaning element as a mitt.

Figure 3:
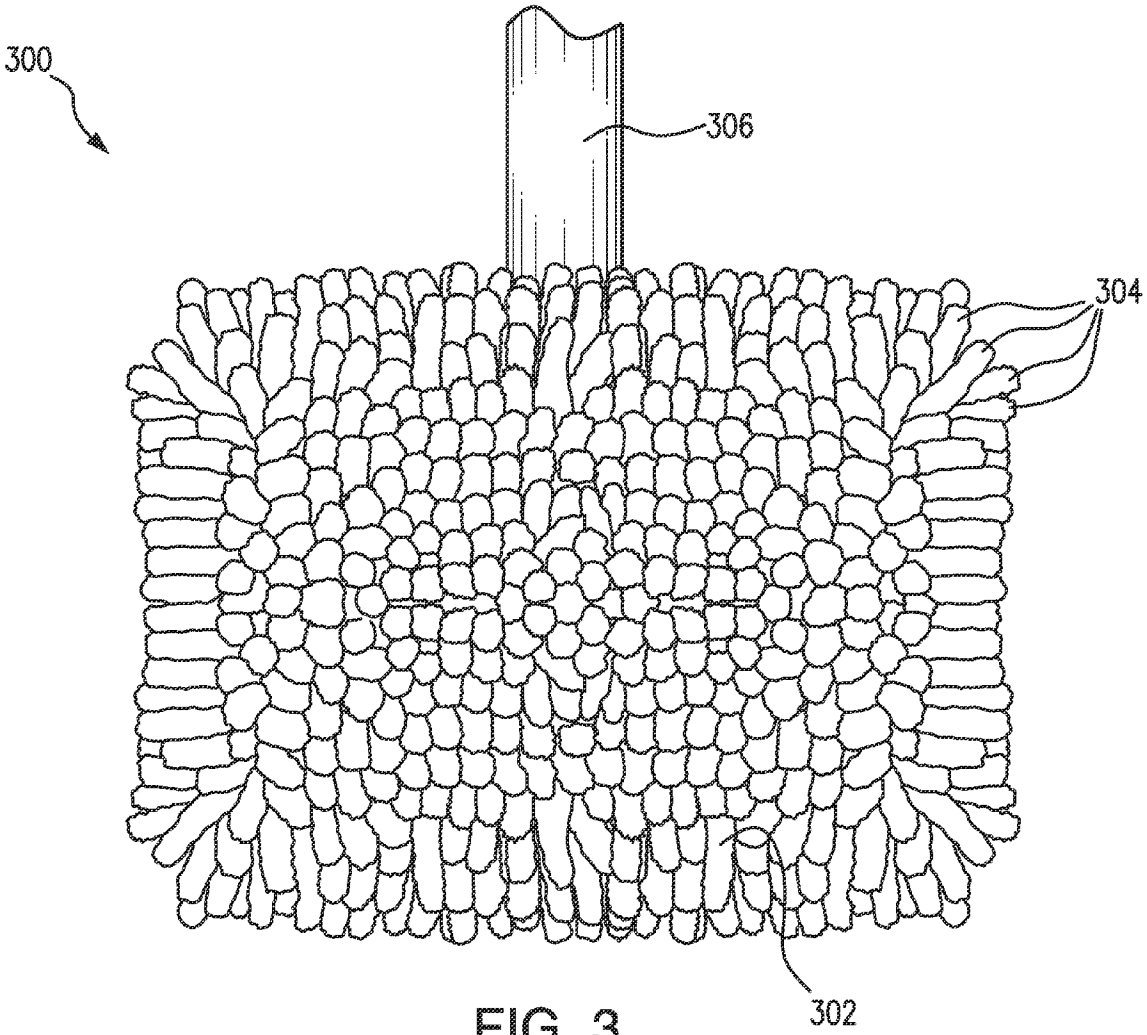
FIG. 3 is a view of the underside of the mitt in accordance with some embodiments of the present invention.

Now referring to FIG. 3, which is a view 300 of the underside of the mitt in accordance with some embodiments of the present invention. View 300 is an illustration of the front surface 302 of the cleaning element. The front surface 302 includes the plurality of elongated members 304. As discussed above, the plurality of elongated members can be made of many types of material, such as microfiber, foam, nylon, etc. The elongated members 304 are flexible but can be either stiff or soft depending on the cleaning element and the surface to be cleaned. For example, when cleaning a rough surface, such as concrete, brick, etc., the elongated members 304 may be made of a more stiff material, such as nylon bristles. Whereas, when cleaning rain gutters or siding, the elongated members 304 may be made of a microfiber material or foam. View 300 is an example of what a user might see when looking directly at the underside, cleaning surface, or front surface 302 of the product.

Figure 4:
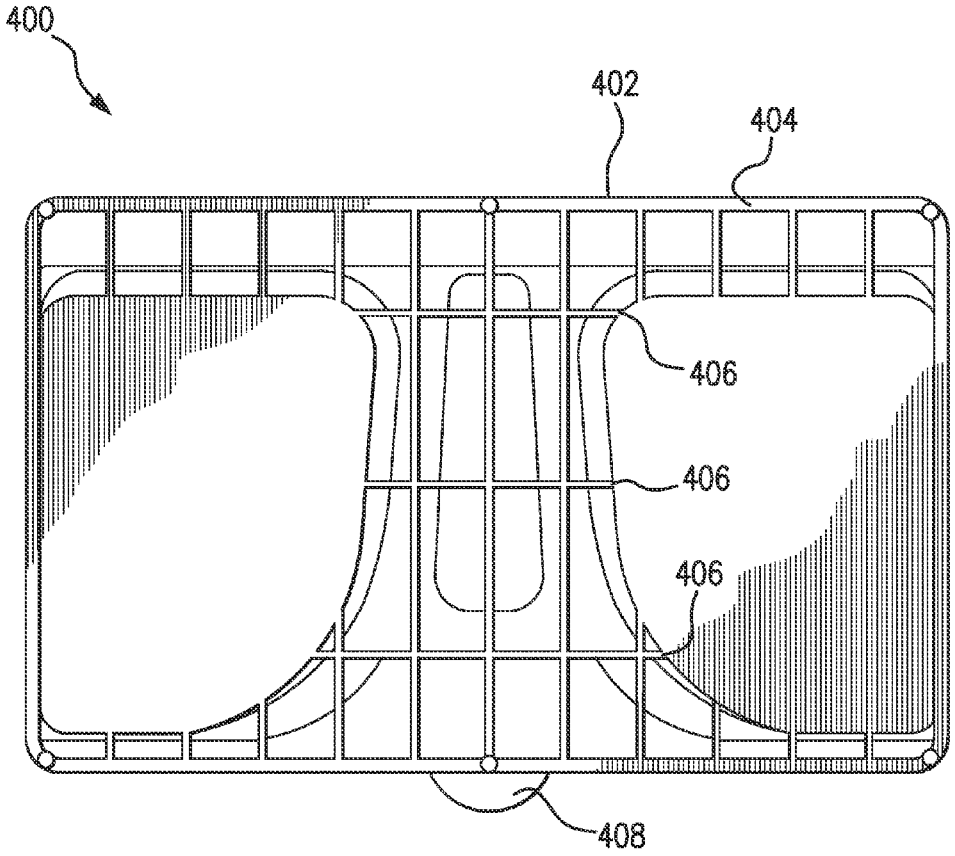
FIG. 4 is a view of the underside of the support member in accordance with some embodiments of the present invention.

Now referring to FIG. 4, which is a view 400 of the underside of the support member in accordance with some embodiments of the present invention. View 400 includes a support member 402. Support member 402 includes the bottom portion 404, a grid support structure 406, and a connector 408. The grid support structure 406 is just one example of a configuration of a support structure that could be utilized on the bottom portion 404 of the support member 402. It should be appreciated that the grid support structure 406 is not limited to only a grid configuration. The grid support structure 406 may be implemented in other configurations as to provide support, stability and rigidity to the support member 402. For example, the grid support structure 406 may also be configured into triangles and other various shapes. The connector 408 is capable of receiving a pole for performing cleaning tasks at a distance or height from the user of the product. An optional feature is a pivot means that provides movement between the product and the connector so that the product can pivot in different directions. The pivot means allows the product to be flush against a cleaning surface regardless of the application angle of the product.

Figure 5:
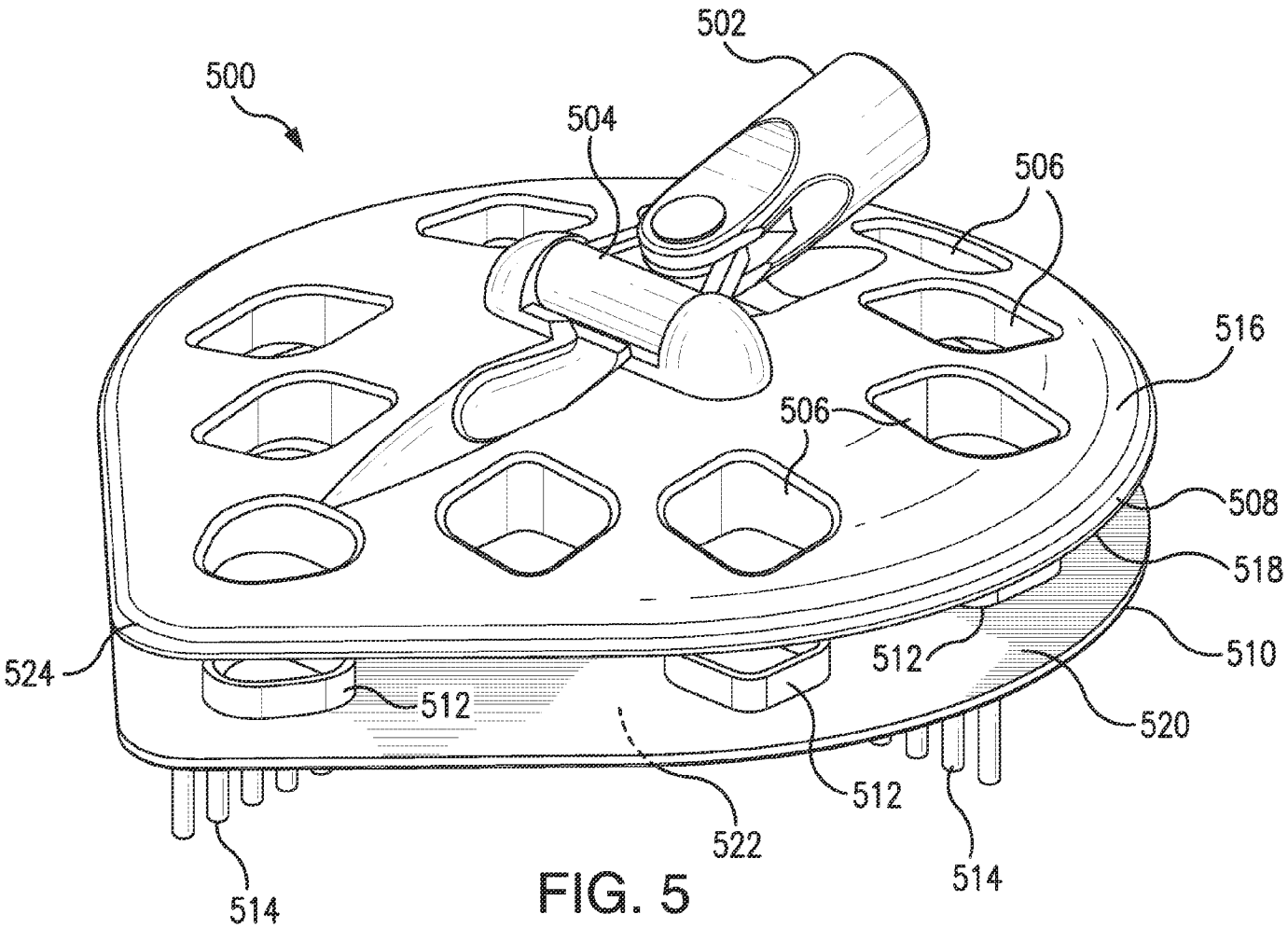
FIG. 5 is an exploded view of another embodiment of the product in accordance with some embodiments of the present invention.

Now referring to FIG. 5, which is an exploded view 500 of another embodiment of the product in accordance with some embodiments of the present invention. View 500 includes a support member 508 and an alignment plate 510. The support member 508 includes a connector 502, a pivot means 504, a plurality of spaced recesses 506, a top portion 516 and a bottom portion 518. The connector 502 provides for receiving a pole, and pivot means 504 allows the connector 502 to pivot in multiple different directions. The plurality of spaced recesses 506 provides for removable attachment to the alignment plate 510. The plurality of spaced recesses 506 allow for a secure and stable fit between the support member 508 and the alignment plate 510. The plurality of spaced recesses 506 may be on the bottom portion 518 of the support member 508. The plurality of spaced recesses 506 may be visible from the top portion 516 of the support member 508.

The alignment plate 510 includes a back surface 520, a front surface 522, a plurality of spaced protuberances 512 and elongated members 514. The alignment plate 510 provides elongated members 514, which may be nylon bristles, that may be used for cleaning harder or rough surfaces, such as those made of concrete, brick or cement. The alignment plate 510 would also be used on surfaces that might be sharp or rough that could cause damage to the mitt or cleaning element. The elongated members 514 are located on the front surface 522 of the alignment plate 510.

The connection of the alignment plate to the structural support may be done in a number of ways. In one way, the support member 508 is provided with a number of spaced recesses 506, whereas the alignment plate 510 is provided with the same number of spaced protuberances 512 that mate with the recesses 506. The reverse can also be done whereas the alignment plate 510 is provided with recesses 506 and the support member 508 is provided with the protuberances 512 (not shown). Another option can be a slide or track arrangement, wherein the alignment plate 510 has side ends or bars configured to meet with and slide in corresponding channels on the support member 508. This arrangement works best when the shape of the alignment plate 510 and support member 508 have linear edges or similar configurations that allows for a sliding movement for attachment. The type of connection between the alignment plate 510 and the support member 508 is not critical provided that is sufficiently secured to prevent release of the alignment plate 510 from the support member 508 during cleaning operations. The alignment plate 510 includes elements opposite of the elements of the support member 508 to securely attach the alignment plate 510 to the support member 508. When the support member 508 and the alignment plate are connected, the configuration would be such that the bottom portion 518 of the support member 508 would be flush against the back surface 520 of the alignment plate 510.

Also, it should be noted that the support member 508 and the alignment plate 510 are in a circular shape with a point or corner at one end 524. The point or corner 524 aids in providing sufficient access to more square or right angled shapes that the otherwise circular shape of the rest of the surface area of the product might not be able to access. The shape illustrated in this drawing is just one example of the shape implementation of the support member 508 and the alignment plate 510. As discussed above, the support member and cleaning element, such as a mitt or alignment plate, can be any number of shapes, such as a circle, rectangle, triangle, oval, etc. Also the point or corner 524 may be incorporated into any shape of the support member or cleaning element.

Figure 6:
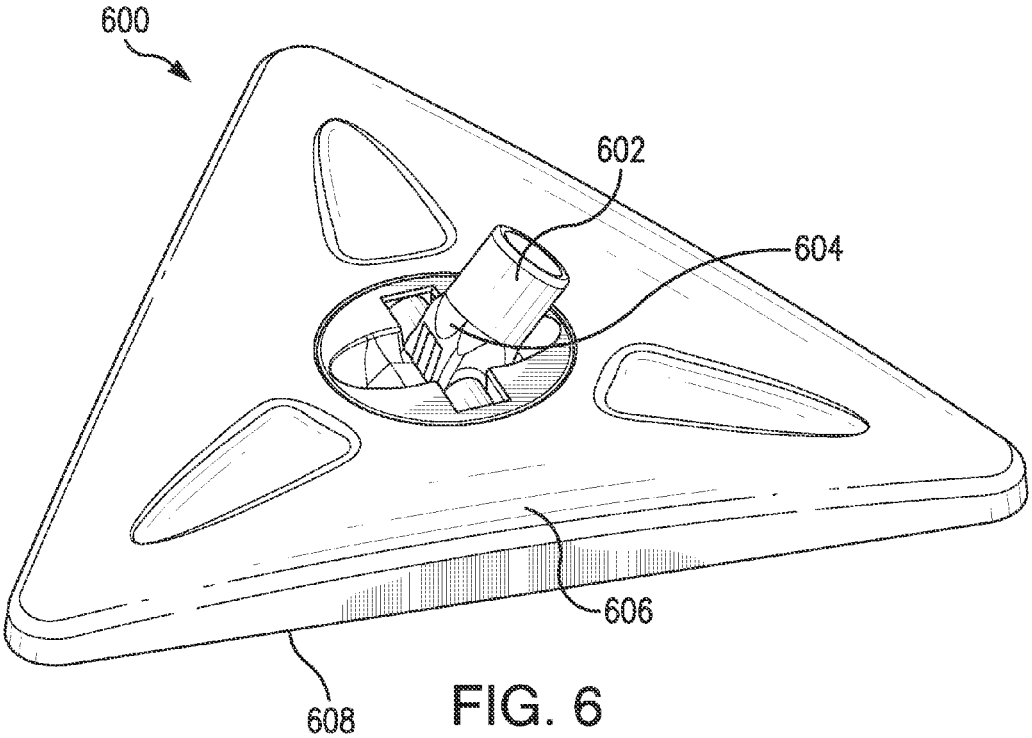
FIG. 6 is view of another embodiment of a support member according to an embodiment of the invention.

Now referring to FIG. 6, which is top view 600 of another embodiment of a support member according to an embodiment of the invention. View 600 includes a support member with connector 602, a pivot means 604, a top portion 606 and a bottom portion 608. The support member illustrated in view 600 is in a triangular shape. The advantages of the triangular shape of the support member includes allowing easy access to hard to reach areas, such as corners.

An exemplary process of the present invention for cleaning outdoor surfaces includes attaching a pole to the connector of the cleaning element. As discussed above, the pole may be any number of handles, extension poles, etc. The pole also may attach to the connector of the support member through a universal thread by screwing the pole into the connector. As discussed above, the connector may also include a pivot means for providing a pivot function between the pole and the product.

A cleaning agent is preferably used to assist in the cleaning operation. This agent can be water alone or a solution of water and a detergent or other dirt dissolving or removing chemicals. The cleaning solution may be any number of solutions, such as water, ammonia, or any other cleaning agent suited for cleaning the exterior of a home or building. A proprietary solution known as the Chomp Gutter & Metal Trim Cleaner is preferably used as the cleaning solution for optimal results when cleaning home rain gutters. This solution is simply added to water in a bucket and the support member with the mitt or cleaning element embodiment is immersed into the solution before being applied to clean the rain gutter or other exterior surface. In addition, it is also possible to pre-wet the surface to be cleaned with water or to prewash it with a spray of chemical cleaning agent before applying the cleaning device thereto. A skilled artisan can easily determine the optimum cleaning sequence depending on the type of surface to be cleaned and the degree of dirt contamination. The cleaning solution may also be used with the alignment plate embodiment.

A person cleaning the exterior of a home or building would hold the pole and position the product on the desired surface to be cleaned. In the mitt embodiment, the front surface of the mitt and the elongated members should be placed against the surface to be cleaned. In the alignment plate embodiment, the bristles should be placed against the surface to be cleaned. Then, performing cleaning motions along the outdoor surface with the flexible elongated members of the cleaning element (or bristles of the alignment plate). Cleaning motions may include any number of motions, including but not limited to, wiping, scrubbing, scraping, rubbing, etc.

Upon completion of the cleaning process of the outdoor surface, the support member can be removed from the cleaning element so that the cleaning element may be washed or otherwise cleaned prior to subsequent use. For example, after cleaning the siding or gutters of a house or building, the cleaning element would most likely be very dirty. It is very convenient that the support member is removable from the cleaning element so that the cleaning element may be cleaned. Because the support member is enclosed within the cleaning element, it is most likely that the support member does not need to be cleaned but in the event that it does need to be cleaned, the support member is made of a material that is easy to clean, such as a plastic material. Therefore, the support member may be easily just rinsed off with some soap and water and wiped clean. The cleaning element may be washed in a washing machine with regular laundry detergent or hand washed. Also, the alignment plate can be made of a material similar to the support member and is easily cleaned.

Features or characteristics described in one context, process, or device are applicable to other context, process or devices described herein. The steps of the processes illustratively described herein can be performed in a different order, if desired. Also, steps could be added or removed from the processes illustratively described herein. The processes illustratively described herein can be implemented using the described examples of hardware and network configurations.

The terms and expressions which have been employed in the specification are used as terms of description and not of limitations, there is no intention in the use of such terms and expressions to exclude any equivalents of the features shown and described or portions thereof, but it is recognized that various modifications are possible within the scope of the claims to the invention.

What is claimed is:

1. A cleaning product comprising:

a one-piece, rigid support member made of plastic or metal and having a rectangular, square, circular, or oval shape that includes a point or corner for providing access to square or right angled areas to be cleaned, with the support member comprising similarly shaped top and bottom portions, wherein the top portion includes a connector configured and dimensioned for receiving and attaching a pole thereto, and the bottom portion includes a structural support comprising a reinforcing grid forming the bottom portion for providing support, rigidity and stability to the support member; and a cleaning element associated with the support member, wherein the cleaning element is configured as a mitt having front and back surfaces and an opening on the back surface for receiving and enclosing the support member therein, with the mitt having the same shape as the support member and including, on the front surface, a cleaning face and a plurality of spaced, flexible elongated cleaning members arranged upon the cleaning face, with the cleaning face operatively associated with the support member, and having an inside surface that is flush with and adjacent the entire bottom portion of the support member, wherein the cleaning element is made of a polymeric material that is washable, durable and absorbent so that it can be refreshed between cleaning uses, and wherein the structural support transfers cleaning forces to the cleaning element and cleaning members during use;

wherein the connector includes internal threads configured for mating with external threads on one end of a pole that provides added strength and stability of the cleaning product during use.

2. The product of claim 1, wherein the cleaning face and the elongated members are made of nylon or microfiber material.

3. The product of claim 1, wherein the mitt includes an enclosing means to further secure the support member between the front and back surfaces but that allows the mitt to be removable from the support member when not in use.

4. The product of claim 3, wherein the enclosing means comprises a closure element associated with the opening of the mitt, the closure element including mating portions for joining the front and back surfaces while securing the support member therebetween.

5. The product of claim 4, wherein the closure element comprises hook and loop fasteners, a zipper, male and female snaps or a button and hole arrangement.

6. The product of claim 1, further comprising a foam member positioned and located between the inside surface of the cleaning face of the cleaning element and the bottom portion of the support member, the foam member comprising porous material that provides compressibility to the cleaning face to assist in conforming the cleaning face to an area to be cleaned and to assist in transferring cleaning forces to the cleaning face.

7. The product of claim 1, wherein the connector further comprises pivot means that allows the product to retain flush contact with an outdoor surface regardless of application angle.

8. The product of claim 1, wherein the shape of the support member is in the shape of a teardrop.

9. A method for cleaning outdoor surfaces, which comprises:

attaching a pole to the connector of the support member of the cleaning product of claim 1; and performing cleaning motions along the outdoor surface with the flexible elongated members of the cleaning element, optionally with the addition of a cleaning agent.

10. The method of claim 9 wherein upon completion of the cleaning of the outdoor surface, removing the support structure from the cleaning element so that the cleaning element may be washed or cleaned prior to subsequent usage.

11. The method of claim 9 wherein the outdoor surface is a roof-mounted rain gutter, a window or siding, wherein the pole has a length of between 5 and 25 feet to allow access to such outdoor surface for cleaning thereof.

12. The product of claim 7, wherein support member has a rectangular shape that includes a point or corner for providing access to square or right angled areas to be cleaned, and wherein the bottom portion of the structural support comprises a rectangular reinforcing grid arranged on the bottom portion for providing support, rigidity and stability to the support member; and the cleaning element and elongated cleaning members are made of nylon or a microfiber material.

13. The product of claim 12 further comprising a pole having a length of between 5 and 25 feet to allow access to outdoor surfaces for cleaning thereof.

14. The product of claim 12, further comprising a foam member positioned and located between the inside surface of the cleaning face of the cleaning element and the bottom portion of the support member, the foam member comprising porous material that provides compressibility to the cleaning face to assist in conforming the cleaning face to an area to be cleaned and to assist in transferring cleaning forces to the cleaning face.

15. The product of claim 7, wherein support member has a teardrop shape that includes a point or corner for providing access to square or right angled areas to be cleaned, and wherein the bottom portion of the structural support comprises a rectangular reinforcing grid arranged on the bottom portion for providing support, rigidity and stability to the support member; and the cleaning element and elongated cleaning members are made of nylon or a microfiber material.

16. The product of claim 15 further comprising a pole having a length of between 5 and 25 feet to allow access to outdoor surfaces for cleaning thereof.

17. The product of claim 15, further comprising a foam member positioned and located between the inside surface of the cleaning face of the cleaning element and the bottom portion of the support member, the foam member comprising porous material that provides compressibility to the cleaning face to assist in conforming the cleaning face to an area to be cleaned and to assist in transferring cleaning forces to the cleaning face.

* * * * *